United States Patent [19]

Binder et al.

[11] Patent Number: 5,004,507

[45] **Date of Patent: * Apr. 2, 1991**

[54] AQUEOUS-ALCOHOL FRUCTOSE CRYSTALLIZATION

[75] Inventors: Thomas P. Binder; Robert M. Logan, both of Clinton, Iowa

[73] Assignee: Archer Daniels Midland Company, Decatur, Ill.

[ * ] Notice: The portion of the term of this patent subsequent to Jan. 23, 2007 has been disclaimed.

[21] Appl. No.: 429,757

[22] Filed: Oct. 31, 1989

Related U.S. Application Data

[63] Continuation-in-part of Ser. No. 283,188, Dec. 12, 1988, Pat. No. 4,895,601.

[51] Int. Cl.[5] ..... C13F 1/02; C13F 1/04

[52] U.S. Cl. ..... 127/58; 127/60; 127/61; 127/62

[58] Field of Search ..... 127/58, 60, 61, 62

[56] References Cited

U.S. PATENT DOCUMENTS

| | | | |
|---|---|---|---|
| 3,513,023 | 5/1970 | Kusch | 127/58 |
| 3,928,062 | 12/1975 | Yamauchi | 127/60 |
| 4,710,231 | 12/1987 | Bateman et al. | 127/58 |
| 4,724,006 | 2/1988 | Day | 127/58 |
| 4,895,601 | 1/1990 | Binder et al. | 127/60 |

*Primary Examiner*—Chung K. Pak

*Attorney, Agent, or Firm*—Laff Whitesel Conte & Saret

[57] ABSTRACT

A process for crystallizing an aqueous fructose feed stream uses an alcohol mixture which may be crystallized in either a vacuum evaporator chamber or a cooled atmospheric pressure crystallizer. Various cooling cycles are described. When the atmospheric pressure crystallizer is used, the mixture is stirred continuously; therefore, the temperature of the mixture is held low enough to cause crystals to form, but also high enough not to be too viscous to stir and pump.

24 Claims, 2 Drawing Sheets

AQUEOUS-ALCOHOL FRUCTOSE CRYSTALLIZATION

This is a continuation-in-part of Ser. No. 07/283,188, filed Dec. 12, 1988, now U.S. Pat. No. 4,895,601.

This invention relates to processes for the crystallization of fructose and more particularly to continuous processes using alcohol for crystallizing fructose carried in aqueous feed streams.

Even more particularly, this invention involves a mixing of alcohol with a partially crystallized, high-fructose, aqueous syrup ("MAGMA") in order to obtain a mixture which easily and readily crystallizes with a high yield.

In the past, fructose has been crystallized by batch processing methods, a few of such methods being shown and described in patents, such as: Nos. 2,357,838; 3,607,392; 3,704,168; 3,883,365; 4,199,374; 1,710,231; 1,724,006; and British patent 1,117,903. A book entitled "*A Handbook of Sugar Analysis*" by C. A. Browne, copyright 1912 and published by John Wiley & Sons refers to a use of alcohol in the crystallization process (page 618).

Much has been said about "improved" crystallizing methods which increase the harvest of crystals. However, most of the batch processes have involved a seeding step wherein some of the harvest is recycled into an earlier step in order to provide seed crystals to get the crystallization process started. Therefore, it would be better to speak of the net harvest, after the recycled seed material is subtracted from the gross output. After this subtraction, it is found that the net harvest is more or less fixed by the physical properties of the material being crystallized. The starting material contains a certain amount of potential crystal material and that amount less the systemic loss is, within reason, approximately the harvest for all systems.

Accordingly, when appraising a crystallization system the more important considerations are such things as cost, convenience, the amount and nature of capital equipment required, and the like. When viewed from this vantage point, the best system is a continuous one where a processing system has raw material flowing continuously into one end and finished product flowing substantially continuously out the other end. There should be a fairly smooth forward progress of the material as the end product is formed, with a minimum amount of recycling. Any heat cycle should be carried out at a fairly smooth and uninterrupted temperature with a minimum amount of heating and cooling for raising and lowering the temperature where energy is needlessly dissipated. There should be the steady flow of product where automatic controls may hold close tolerances without having to be frequently readjusted to fit the starts and stops associated with batch processing.

Accordingly, an object of this invention is to provide new and improved means for and methods of crystallizing fructose. In this connection, an object is to provide continuous crystallization processes at atmospheric pressures.

Another object of the invention is to provide simple and straight forward fructose crystallization processes which do not require a feed back of seed crystals.

In keeping with an aspect of the invention, these and other objects are accomplished by providing either an atmospheric pressure crystallizer or a vacuum evaporator crystallizer which is held at a temperature lower than the temperature of the saturated stream of fructose syrup. In the atmospheric pressure crystallizer, a cooling coil is used. In the vacuum evaporator, cooling comes from the evaporization. In order to produce a sufficient quantity of continuously available crystals at atmospheric pressure to start and maintain the crystallization process, there should be an efficient mixing at low temperature during the crystallization step. Then, the cooled syrup is mixed with alcohol and held over a cooling period of time which is sufficient to complete or substantially complete the crystallization process. Thereafter, the output of the holding step is fed out as the end product of the inventive system.

BRIEF DESCRIPTION OF THE DRAWINGS

A preferred procedure for carrying out the inventive process is shown in the attached drawing, wherein.

Figure 1:
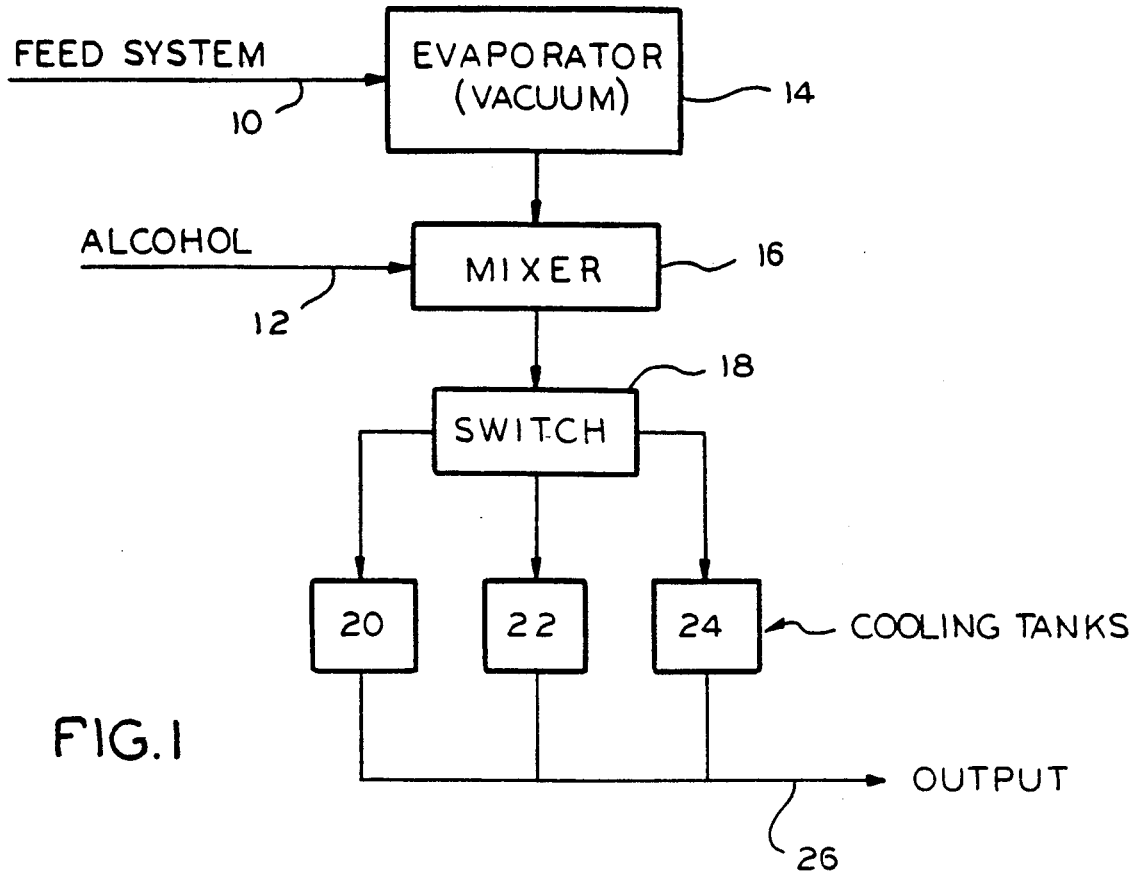
FIG. 1 is a block diagram which shows equipment used in a first process for crystallizing fructose.

A purely aqueous crystallization of fructose is difficult to achieve due to the high viscosity which is encountered during the cooling of the syrup or magma. This high viscosity both requires a slow cooling and makes it difficult to mix the magma. On the other hand, the impacts between the crystals in the syrup is limited by the high viscosity of the magma and so very little heterogeneous nucleation occurs. Also, there is a relatively broad supersaturation zone in which no primary nucleation occurs.

These opposing viscosity factors may be accommodated by continuously running a vacuum crystallizer at a high temperature. Under these conditions of a continuous operation at high temperature, the viscosity of the magma does not become too high to use in a vacuum draft tube crystallizer. As a result, there will be only a moderate rate of heterogeneous nucleation which produces a commercially suitable range of crystal sizes.

Unfortunately, as the total amount of dry substance increases or as the temperature is lowered, the viscosity of the magma becomes too great for this type of vacuum crystallizer. Then, the magma is transferred to a more conventional batch crystallizer with slow cooling in order to obtain a good yield of product.

According to the invention, a low viscosity magma may be provided by mixing a partially crystallized magma with alcohol. This low viscosity magma has sufficient crystal surface area to provide a continuous growth of the crystals without the need for adding crystalline seed. As a result, a flowable crystalline product can be obtained by mixing an alcohol with an aqueous feed stream magma. The inventive process does not form either a precipitate or slime. Contrast this result with the process described in U.S. Pat. No. 4,724,006 (Gary A. Day) which says that a mixing of the magma and alcohol is a very delicate step which requires the addition of alcohol at an elevated temperature of 50° C. to 80° C. (122° F. to 176° F.) in order to prevent the formation of precipitates and slime.

Moreover, according to the invention, the alcohol may be added to the magma at substantially any reasonable temperature, either hot or cold. The resulting inventive mixture can be cooled over a relatively short period of time to produce crystalline fructose with an excellent harvest.

The inventive process for the crystallization of the aqueous magma in a continuous vacuum crystallizer requires a feed stream containing a syrup which is between approximately 85% and 95%, and preferably between 87% and 93%, dry solids weight/weight. The fructose purity of these dry solids should be between approximately 85% and 100% fructose, and preferably between 93% and 98% (93-98%). Substantially all of the remaining dry solids should be other sugars. Preferably the incoming feed stream is at a temperature in the vicinity of about 150° F., although a wide range of temperatures, such as approximately 130°-180° F., for example, may be used.

The incoming feed stream may have a starting pH determined by the physical properties and recent history of the fructose. In greater detail, the concern about pH in fructose crystallizing processes is usually tied into the duration of a holding time. If it sets for any extended time period, the pH of almost any fructose syrup will inherently equilibrate around 4.0-5.0. However, there is very little or substantially no concern about pH if the fructose solution goes directly into the evaporator with no prior holding time. Accordingly, within reason, almost any naturally occurring pH may be used, but the naturally occurring range of about 4 to 4.5 is preferable.

The temperature of the vacuum crystallizer is maintained between substantially 105° F. and 130° F., and more preferably between 110° F. and 120° F. Within the crystallizer, a balance of temperature, dry substance, vacuum, and feed rate is maintained in order to obtain a continuous crystallizer outflow of product with between approximately 5% to 40%, and preferably between 15 and 25%, of the fructose crystallized.

In another embodiment, the feed stream is introduced into an atmospheric pressure crystallizer which is held at a temperature that is much lower than the temperature of the feed stream. A very efficient mixing is carried out to agitate the feed stream while it is in the atmosphere crystallizer.

After the crystallizer, the outgoing feed stream of product is mixed with alcohol and fed into a batch crystallizer at between substantially 100° F. and 125° F., and more preferably between 105° F. and 110° F. The batch is cooled in the batch crystallizer or in a series of batch crystallizers at lower temperatures. The final temperature at the output of the batch crystallizer may be between substantially 60° F. and 80° F., and preferably between 65° F. and 75° F. The cooling should occur over a time period in the order of 10 to 24 hours.

The equipment (FIG. 1) for practicing the inventive process includes a continuous feed stream input 10, an alcohol input 12, a vacuum evaporator 14, a mixer 16, a switching manifold 18, and a suitable number of holding tanks 20-24. The output of the system is taken from holding tanks 20-24 and appears at 26. Surge tanks (not shown) may be provided where required in order to smooth the flow of the crystallizing stream.

The seed crystallizer 14 may be any suitable device such as a vacuum draft tube crystallizer. The seed crystallizer is a vacuum draft tube type that permits internal circulation of liquid up through the center of the tube. Boiling occurs at the top surface of the liquid. The height of the liquid in the vessel is about 1.5 times the diameter. Sufficient space is provided above the surface of the liquid to provide for entertainment separation and vapor removal. The draft tube is about 50% of the diameter of the vessel. Temperature is controlled by the amount of vacuum applied. Vapor is condensed and can be returned to the vessel, if desired.

This evaporator manufactured by Swenson Process Equipment Inc. of Harvey, Ill., 60426. This evaporator operates at an internal temperature range in the order of about 105° F. to 130° F., with a preferred range of about 110°-120° F. As it enters the evaporator, the incoming fructose feed stream should experience an almost instantaneous temperature reduction of about 20°-40° F. in order to cause a substantially immediate crystallization of some of the solution. By maintaining a proper balance of temperature, dry substance, vacuum, and a continuous feed rate, approximately 5-40% of the fructose crystallizes in the evaporator. The preferred range of crystallization within the evaporator is 15-25% of the total fructose. The output product stream from the evaporator should contain enough water to enable it to flow and be pumped. If necessary, water may be added.

In another type of crystallizer, the chamber is at atmospheric temperature, but it contains an efficient mixing machine and a cooling coil. The cooling coil holds the mixture in the crystallizer at a temperature in the range of approximately 110° F. to 135° F., with a preferred range being 120° F. to 130° F. It has been found that, at this temperature range, the mixture does not become too viscous and efficient mixing may be achieved. If the temperature should be too much lower than this range, the mixture would become very difficult to pump.

The design and operation of the mixing machine used in the atmospheric crystallizer involves a balancing of forces to achieve a desired result. Usually, the manufacturer may have a desired ending crystal particle size. For some uses, the desired crystal particle may be larger and for other uses, it may be smaller. In general, less shear in the mixer produces larger particles and more shear produces smaller particles. There are two sources of shear, the mixer blade and crystal nuclei or seeds passing each other. It is thought that, for most uses, the preferred mixer would have little or no shear and the end product would have larger crystals. Accordingly, a mixing speed is set to gain the desired end product crystals.

Another factor to consider in selecting whether to use an atmospheric or vacuum crystallizer revolves around the amount of water that is desired in the outgoing feed stream issuing from the crystallizer. When a vacuum crystallizer is used, much of the water in the incoming feed stream is evaporated. If at least some of that amount of water is not put back into the outgoing feed stream, it will have more crystals per unit volume and, therefore, will be more viscous and harder to pump. If an atmospheric crystallizer is used, not as much water is extracted during the crystallization process, and the outgoing feed steam leaving the crystallizer is less viscous.

The product leaving the crystallizer 14 and entering the mixer 16 is mixed with alcohol which may be dumped directly into the magma with or without controlled mixing. Any suitable food quality alcohol may be used, but ethanol is preferred. The ratio of alcohol to magma should be in the range of from about 3 to 1 to about 1 to 3 parts alcohol, with a ratio of 1:1 preferred. The mixing of the product with the alcohol occurs within the temperature range of approximately 100°-125° F. and preferably between about 105° F. and 110° F. It may be desirable to pre-cool the alcohol in order to accomplish a mixing within this temperature range.

Then, the alcohol and fructose mixture is fed through a switching manifold 18 to cooling and holding tanks 20, 22 24 (FIG. 1). The manifold switching is such that one tank is always filling, while a second tank is holding, and a third tank is emptying so that there is a substantially continuous and uninterrupted flow of product into and out of the tanks. In the tanks 20, 22, 24, the cooling is preferably with the final outflow temperature at 26 being in the range of about 60°-80° F., with a range of 65°-75° F. preferred. The total cooling time for the product to move through tanks 20-24 is in the order of about 10 to 24 hours.

Figure 2:
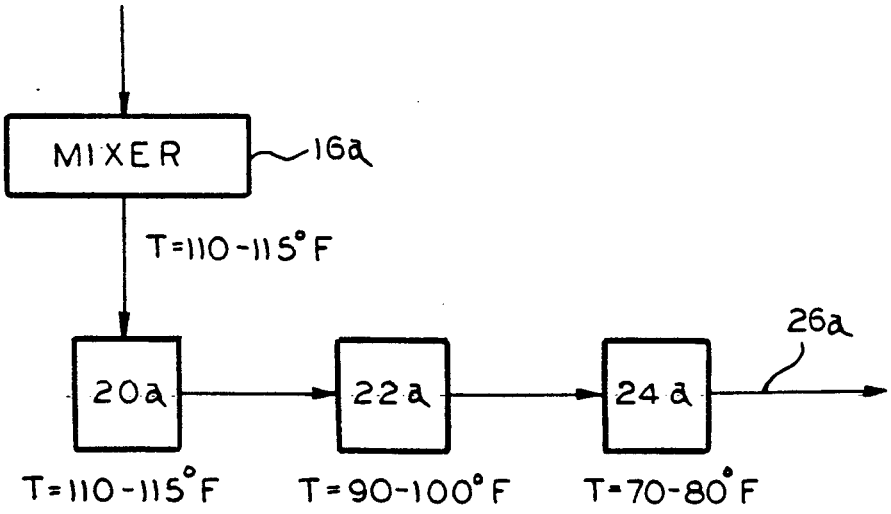
FIG. 2 is a block diagram which shows equipment used in a second process for crystallization of fructose.

In the embodiment of FIG. 2, the various temperatures and holding times are approximately the same as they are for FIG. 1. However, the system is different in that the cooling tanks **20*a*-24*a*** are coupled together in cascade so that the product moves from tank to tank in a substantially continuous flow with approximately a third of the total temperature change occurring in each of the tanks. The temperature of the product stream entering the individual tanks was about 110°-115° F. at tank 20*a*, 90°-100° F. at tank **22*a*, and 70°-80° F. at tank 24*a*. In the embodiment of FIG. 2, the product flow is directly from the mixer 16*a* to the cooling tank 20*a* without requiring the switching manifold 18 of FIG. 1**.

With the inventive system and process, there is no need for seeding at the input end of the original feed stream. Therefore, all of the crystals harvested at the output end 26 are available as a finished product, which is set to be in the order of 60% to 65% of the available fructose in the inflowing feed stream. The actual amount of the yield depends upon final temperature, the cost of holding for longer cooling periods, and the pumpability of the material as compared to other forms of material handling. Thus, higher yields may be achieved, but the cost might be greater than desirable. Also, without changing the inventive process, the yields may be set at different levels as the costs of the various parameters may vary, from time to time.

In general, the inventive system makes no attempt to control the crystal size since there is a ready market and need for crystals of all the sizes that are produced by the system. However, it has been found desirable to sort the crystals by size since any given customer usually want a specific size for its specific purposes. It has been found that, with the inventive system, approximately 40% of the crystals did not pass through a 40-mesh screen; 37% did not pass through an 80-mesh screen; and 20% passed through the 80-mesh screen.

EXAMPLE 1

In this first example, 800 grams of magma was obtained from a production scale, continuous vacuum draft tube crystallizer operating at 116° F. and with 29.2 inches gauge vacuum. Over the time period during which it was collected, the magma averaged 90.6% total dry solids w/w which was 95.3% fructose, with 21.4% of the fructose crystallized. To the magma was added 800 grams of 95% ethanol at 110° F. The resulting mixture was placed in a crystallizer at 100° F. Over a sixteen hour period, the temperature of the mixture was allowed to decrease linearly to 75° F. The product was collected by filtration and dried. The yield was 491 grams, With 71% of the fructose crystallized.

EXAMPLE 2

Fructose was crystallized as in Example 1 with the following conditions and results:

| Total Percent Fructose | Percent Dry Solids W/W | % Fructose Crystallized In Evaporator | Grams Fructose Magma | Grams 95% EtOH | Starting Temp. °F. | Final Temp °F. | Time Hours | Yield |
|---|---|---|---|---|---|---|---|---|
| 95.4 | 90.6 | 21 | 800 | 800 | 116 | 75 | 20 | 65.0 |
| 94.8 | 90.4 | 17.9 | 800 | 800 | 116 | 90 | 20 | 58.0 |
| 95 | 90.6 | 19.5 | 800 | 800 | 110 | 75 | 16 | 68.0 |
| 96.3 | 90.6 | 17 | 800 | 800 | 110 | 75 | 16 | 69.6 |
| 97.4 | 91.1 | 31.6 | 800 | 480* | 110 | 75 | 16 | 74.4 |
| 98 | 92.9 | 43 | 800 | 800 | 110 | 70 | 16 | 73.5 |

*100% EtOH

EXAMPLE 3

800 grams of EtOH at 40° F. was added to 800 grams of vacuum crystallizer product (89.5% dry solids, 97% fructose w/w, which had been 17.35% crystallized, 100° F.) and were mixed in a beaker. The temperature after mixing was 65° F. The mixture was stirred at 75° F. The product crystallized out without producing an oil or precipitate.

EXAMPLE 4

The approximate solubility of fructose in ethanol-water solutions was determined, in order to find the yield of fructose when using varying amounts of alcohol and fructose syrup. Various saturated solutions of fructose were prepared at 75° F. Their composition was determined by high performance liquid chromatography.

| % Ethanol Wt/Wt | Grams Fructose/100 Grams EtOH $H_2O$ Mixture |
|---|---|
| 50 | 180 |
| 60 | 137.5 |
| 70 | 91 |
| 80 | 59 |
| 90 | 15.43 |

EXAMPLE 5

900 grams of magma were obtained from a production scale continuous vacuum draft tube crystallizer. The magma contained a total of 96% w/w, dry solids a fructose purity of 98%, and crystallized fructose content of 25%. This magma was placed in a constant temperature (125° F.) atmospheric pressure stirred crystallizer. A syrup having 90% dry solids w/w and a 98% fructose purity, held at 140° F., was added at timed intervals, as shown below:

| Fructose Additions Time (Hours) | Grams Syrup Added | Grams Fructose Dry Solids |
|---|---|---|
| 0 | 900 (Initial Charge) | 846 |
| 1 | 282 | 249 |
| 4.5 | 340 | 299 |
| 7.5 | 316 | 278 |
| 12 | 223 | 196 |
| Total | 2051 | 1868 |

The magma in the stirred jar was stirred overnight. At 23 hours the magma was determined to have 20% of the fructose crystallized. Thus, it is shown that new crystals were produced in the atmospheric crystalizer without having to add more seed crystals. 1000 grams of the magma was mixed with 1000 grams of 95% alcohol at 113° F. (i.e. the magma and alcohol were approximately equal parts of the mixture). Every three hours the temperature was reduced in 9° F. steps. After 9 hours the temperature was 86° F. Stirring continued overnight. After 24 hours in the alcohol crystallizer, the temperature was 86° F. and fructose crystals were harvested. Yield was 520 grams or 57%.

Figure 3:
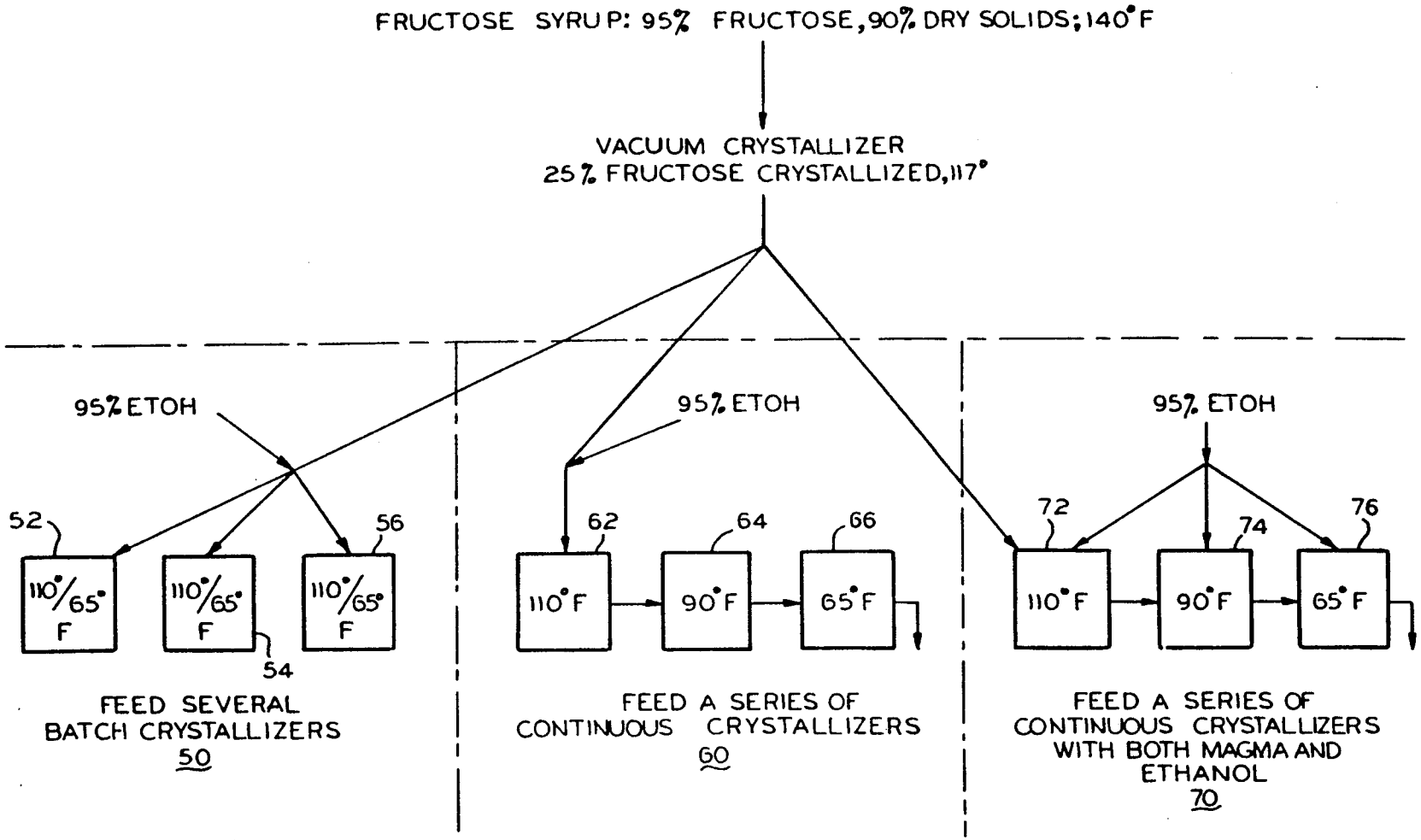
FIG. 3 is a graphic and schematic diagram which illustrates three separate processes which may be used in a factory for continuously producing fructose crystals.

FIG. 3 graphically and schematically shows three different processes which may be used in a factory for large scale production of fructose. In each of these three examples, the incoming feed stream is about 90% dry solids and 10% water at about 140° F. The dry solids are about 95% fructose and 5% other sugars. The feed stream or magma is placed in a vacuum crystallizer at about 117° F.

In a first process illustrated at 50, the stream or magma out of the crystallizer is mixed with 95% ethanol and placed in a first holding tank 52. Then the temperature cools from about 100° F. to about 65° F. When tank 52 is full, the magma stream is diverted to tank 54. When it is full, the stream is diverted to tank 56. While tank 56 is filling, tank 52 is emptying. Therefore, there always is an output stream of product. In each holding tank, the product cools from about 110° F. to 65° F.

In a second process illustrated at 60, the ethanol is added to the magma stream out of the crystallizer before the magma reaches the tanks 62, 64, 66 which are cascaded. The mixture cools to 100° F. in tank 62, 90° F. in tank 64, and 65° F. in tank 66.

In the process illustrated at 70, the three tanks 72, 74, 76 are cascaded and the temperatures are the same as in the process illustrated at 60. However, in the process illustrated at 70, the ethanol is added, approximately in thirds by volume, to each of the tanks 72, 74, 76. Since the ethanol is added to the three tanks at temperatures of 100° F., 90° F., and 65° F., respectively, this should be the most energy efficient process because less heat is required to bring the ethanol to the temperatures in the second and third tanks.

Those who are skilled in the art will readily perceive how the inventive process may be modified. Therefore, the appended claims should be construed to include all equivalent processes which fall within the scope and the spirit of the invention.

The claimed invention is:

1. A continuous process for crystallizing fructose comprising the steps of:

(a) supplying an unseeded incoming aqueous fructose feed stream at a temperature in the order of about 130°-180° F.;

(b) placing said feed stream in an evaporator having an internal temperature in the range of about 105°-130° F.;

(c) continuing an evaporation within said evaporator until there is a crystallization of about 5-40% w/w of the total dry solids of fructose in said feed stream;

(d) discharging the partially crystallized magma content of said evaporator into a mixer and adding alcohol to said mixer with a mixture ratio in the range of from about 3 to 1 by weight to about 1 to 3 by weight of alcohol to said partially crystallized fructose feed stream;

(e) discharging the mixture from said mixer into at least one holding tank;

(f) cooling said mixture in said holding tank over a period of approximately 10-24 hours to a final temperature in the range of about 60°-80° F.; and (g) removing and drying the contents of said holding tank.

2. The process of claim 1 wherein said temperature range of step (a) is in the range of about 110°-120° F.

3. The process of claim 1 wherein the temperature range of step (b) is in the order of 110°-130° F

4. The process of claim 1 wherein the crystallization of step (c) is in the order of 15-20% w/w of the total dry solids.

5. The process of claim 1 wherein the ratio in step (d) of said alcohol to said partially crystallized fructose magma is 1 to 1.

6. The process of claim 1 wherein the final temperature in step (f) is in the range of about 65°-75°.

7. The process of claim 1 wherein said temperature range of step (a) is in the range of about 110°-120° F., and the temperature range of step (b) is in the order of 110°-130° F.

8. The process of claim 1 wherein said temperature range of step (a) in the range of about 100°-120° F., the temperature range of step (b) is in the order of 110°-130° F., and the crystallization of step (c) is in the order of 15-20% w/w of the total dry solids.

9. The process of claim 1 wherein said temperature range of step (a) is in the range of about 110°-120° F., the temperature range of step (b) is in the order 100°-130° F., the crystallization of step (c) is in the order of 1-20% w/w, of the total dry solids, and the ratio in step (d) of said alcohol to said partially crystallized fructose is 1 to 1.

10. The process of claim 1 wherein said temperature range of step (a) is in the range of about 110°-130° F., the crystallization of step (c) is in the order of 15-20% w/w of the total dry solids, the ratio in step (d) of said alcohol to said partially crystallized fructose magma is 1 to 1, and the final temperature in step (f) is in the range of about 65°-75° F.

11. The process of claim 1 wherein there are at least three of said holding banks in step(e) and means for continuously filing at least one tank, emptying at least one tank, and holding said mixture in a third tank.

12. The process of claim 11 and means for switching said discharge of step (e) between said at least three holding tanks so that said mixture stays in one of said holding tanks throughout the entire cooling time of step (f).

13. The process of claim 1 wherein there are at least three cascaded holding tanks so that said mixture flows into one of said holding tanks and then through a second tank which in turn flows into a third tank so that said mixture remains in each holding tank for approximately one-third of the total cooling time required for step (f).

14. The process of claim 1 wherein said alcohol is ethanol.

15. A continuous process for crystallizing fructose at atmospheric pressure, comprising the steps of:

(a) supplying an incoming unseeded aqueous fructose feed stream at a temperature of about 130° F. to 180° F.;

(b) placing said unseeded aqueous feed stream of fructose in an atmospheric pressure crystallizer containing a cooled mixture which is continuously held in the temperature range of about 110° F. to 135° F.;

(c) stirring said mixture in said crystallizer throughout an extended period of time, (d) adding alcohol to a partially crystallized outgoing feed stream produced during step (c);

(e) stirring the resulting mixture of said alcohol and the partially crystallized feed stream while continuing to hold it at a cool temperature over an extended time period to further crystallize the fructose in the mixture, and (f) collecting, filtering, and drying the resulting crystals after completion of step (e).

16. The process of claim 15 wherein said atmospheric crystallizer is held at a temperature in the range of 120° F. to 130° F.

17. The process of claim 15 wherein said atmospheric crystallizer has an average temperature of about 125° F.

18. The process of claim 15 wherein increments of said incoming feed stream of step (a) are added to said atmospheric crystallizer, about 90% dry solids w/w at approximately 98% fructose purity, and a temperature of about 140° F.

19. The process of claim 18 wherein the mixture in the outgoing steam of step (d) are approximately equal parts of said alcohol and of a magma from said crystallizer.

20. The process of claim 19 wherein the alcohol of claim 19 is approximately 95% pure alcohol and has a temperature of about 113° F.

21. The process of claim 15 wherein the temperature of said mixture is reduced periodically during step (d).

22. The process of claim 21 wherein said temperature reduction is 9° F. every three hours.

23. The process of claim 15 wherein said stirring is continuous throughout steps (b)–(f).

24. The process of claim 23 wherein said stirring in each of the steps (c) and (e) was continued throughout a period of approximately one day for each step.

* * * * *

UNITED STATES PATENT AND TRADEMARK OFFICE

CERTIFICATE OF CORRECTION

PATENT NO. : 5,004,507

DATED : April 2, 1991

INVENTOR(S) : Thomas P. Binder; Robert M. Logan

It is certified that error appears in the above-identified patent and that said Letters Patent is hereby corrected as shown below:

Col. 1, lines 19 and 20: "1,710,231; 1,724,006" should read --4,710,231; 4,724,006--.

Signed and Sealed this

Eighth Day of September, 1992

*Attest:*

DOUGLAS B. COMER

*Attesting Officer*

*Acting Commissioner of Patents and Trademarks*